US007940012B2

(12) United States Patent
Park

(10) Patent No.: US 7,940,012 B2
(45) Date of Patent: May 10, 2011

(54) FLICKER PREVENTING APPARATUS OF FLUORESCENT LAMP

(75) Inventor: Young Kook Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 881 days.

(21) Appl. No.: 11/832,733

(22) Filed: Aug. 2, 2007

(65) Prior Publication Data

US 2008/0079369 A1 Apr. 3, 2008

(30) Foreign Application Priority Data

Oct. 2, 2006 (KR) ..... 10-2006-0097069

(51) Int. Cl.
*H05B 37/02* (2006.01)

(52) U.S. Cl. ..... 315/291; 315/209 R

(58) Field of Classification Search ..... 315/209 R, 315/224–226, 291, 307, 56, 244, 245, 247, 315/302, 361, 362
See application file for complete search history.

(56) References Cited

U.S. PATENT DOCUMENTS

| | | | | |
|---|---|---|---|---|
| 6,452,343 | B2 * | 9/2002 | Oostvogels et al. | 315/209 R |
| 6,667,587 | B1 * | 12/2003 | Chang et al. | 315/291 |
| 6,774,579 | B2 * | 8/2004 | Abe | 315/219 |
| 6,998,911 | B2 | 2/2006 | Honda et al. | |
| 2005/0023995 | A1 * | 2/2005 | Ohnishi et al. | 315/291 |

* cited by examiner

*Primary Examiner* — Jacob Y Choi
*Assistant Examiner* — Jimmy T Vu
(74) *Attorney, Agent, or Firm* — Staas & Halsey LLP

(57) ABSTRACT

A fluorescent lamp controlling circuit reduces and/or prevents a fluorescent lamp from suddenly flickering when a power switch is turned on and/or off. Switching operation of a switch that supplies a direct current voltage to the fluorescent lamp is restricted during a transient period to delay a reset signal so that undesired flicker of the fluorescent lamp can be reduced and/or prevented.

10 Claims, 8 Drawing Sheets

200

FLICKER PREVENTING APPARATUS OF FLUORESCENT LAMP

CROSS-REFERENCE TO RELATED APPLICATION

This application claims the benefit of Korean Patent Application No. 2006-97069, filed on Oct. 2, 2006 in the Korean Intellectual Property Office, the disclosure of which is incorporated herein by reference.

BACKGROUND OF THE INVENTION

1. Field of the Invention

Aspects of the present invention relate to a flicker reducing and/or preventing apparatus of a fluorescent lamp, and more particularly, to an apparatus to reduce and/or prevent flicker of a fluorescent lamp that occurs when a switch is turned on and/or off.

2. Description of the Related Art

An image forming apparatus, such as a printer, a multi-function printer, and others include a CCD module to scan an image. Such a CCD module includes a fluorescent lamp for illumination.

For the effective driving of the fluorescent lamp, a direct current (DC) of 24 V is supplied to the fluorescent lamp when electric power is initially supplied to warm up the fluorescent lamp, a DC of 18 V is supplied to the fluorescent lamp during the scanning thereof, and a DC of 12 V is supplied to the fluorescent lamp during a standby state.

A pulse width modulation (PWM) control is utilized to adjust the voltage that is to be supplied to the fluorescent lamp in accordance with the driving statuses of the fluorescent lamp, as listed above.

As shown in FIG. 1A, an activated PWM control signal PWM_LAMP of "LOW" state is applied to a transistor Q1 of a first switching unit A2 via an inverter In to turn on the transistor Q1 so that a field effect transistor (hereinafter, referred to as an 'FET') Q2 is turned on and a DC voltage (such as 24 V) is supplied to the fluorescent lamp L. Accordingly, a PWM control signal PWM_LAMP corresponding to a magnitude of the voltage supplied to the fluorescent lamp is outputted and time when the transistors Q1 and Q2 are turned on is varied so that the DC voltage supplied to the fluorescent lamp L via a smoothing unit A1 can be adjusted. Reference numerals R1, R2, and R3 indicate resistors, a reference numeral C1 indicates a capacitor to remove noise, and a reference numeral Be indicates a bead inductor to remove noise.

As shown in FIG. 1B, when a power switch S/W provided in the image forming apparatus is turned on, a power supplying unit 1 converts an alternating current (AC) voltage into a plurality of direct current (DC) voltages such as DC of 24 V and DC of 5 V, and supplies the converted DC voltages to a controller 2. DC of 24 V is supplied to drive the fluorescent lamp L, and DC of 5 V is supplied to drive the various respective components of the image forming apparatus.

As shown in FIG. 1C, any one of the DC voltages, such as DC of 5 V that is supplied by the power supplying unit 1, is stabilized after a transient period T1 elapses, and the other of the DC voltages, such as DC of 24 V is stabilized after another transient period T1+T2 elapses.

After the transient period T1+T2 elapses, a reset signal output from a reset generating circuit (not shown) is stabilized, and the initializing of the respective components (not shown) is performed by the stabilized reset signal.

After the stabilization of the reset signal, the stabilized DC voltage of 24 V is supplied to the fluorescent lamp L so that the fluorescent lamp L is warmed up.

According to a related art technique to supply voltage by way of PWM control, as shown in FIGS. 1A-1C, when the power switch S/W of the image forming apparatus is turned on, the controller 2 of the image forming apparatus must output the activated PWM control signal to warm up the fluorescent lamp L after the reset signal is generated to reset the various components of the image forming apparatus. However, although the power switch S/W is turned on, if the DC voltage that is output from the power supplying unit 1 of the image forming apparatus does not reach a stabilized state (such as DC of 5 V), but yet the controller 2 outputs the activated PWM control signal PWM_LAMP such as DC of 3 V (during a transient period T1 when the power ramps up), the fluorescent lamp L may flicker when the DC voltage is supplied to the fluorescent lamp L. Moreover, when the fluorescent lamp L is turned off by having the power switch also turned off, the fluorescent lamp L may flicker because the controller may output the activated PWM control signal PWM_LAMP.

As such, when the unexpected flicker of the fluorescent lamp occurs, a flash of bright light is instantaneously emitted from the fluorescent lamp and the flash may surprise a user in spite of a cover over the fluorescent lamp. Moreover, since an inrush current may be introduced instantaneously into the fluorescent lamp when the fluorescent lamp is turned on for a short time, the current becomes a factor in shortening the lifespan of the fluorescent lamp.

SUMMARY OF THE INVENTION

Aspects of the present invention have been made in view of the above-mentioned problems, and other problems where one or more DC voltages are prematurely and/or unintentionally supplied to the fluorescent lamp L, and a controller outputs an activated PWM control signal PWM_LAMP at a wrong time, and an aspect of the invention is to provide an apparatus to reduce and/or prevent flicker of a fluorescent lamp by restricting switching to supply a direct current voltage to the fluorescent lamp when a power switch is operated, and other benefits.

In accordance with an aspect of the present invention, a flicker preventing apparatus of a fluorescent lamp includes a power switch; a power supplying unit to supply a direct current voltage by operation of the power switch; a fluorescent lamp turned on by the direct current voltage from the power supplying unit; a switch switched to control supply of the direct current voltage to the fluorescent lamp; a first switching unit to control the switch; and a second switching unit to restrict operation of the switch to prevent the fluorescent lamp from turning on when the power switch is turned on and off.

The flicker preventing apparatus further includes a reset signal delaying unit to delay an activated reset signal generated in response to the operation of the power switch, and the second switching unit turns the switch off while the reset signal delaying unit delays the activated reset signal. The second switching unit turns the switch off when the reset signal is inactivated. The second switching unit includes a transistor having a collector connected to the first switching unit and an emitter connected to a ground, and a capacitor to remove noise and connected to a base of the transistor and the emitter.

The flicker preventing apparatus further includes a controller to output a lamp controlling signal to the first switching unit so as to adjust the direct current voltage supplied to the fluorescent lamp, the first switching unit includes a transistor, and the transistor of the first switching unit is turned on by the lamp controlling signal activated by the controller, the transistor of the second switching unit is turned on by a delayed reset signal, and the switch supplies the direct current voltage to the fluorescent lamp when the transistor of the first switching unit and the transistor of the second switching unit are both turned on.

The reset signal delaying unit includes a first resistor to receive a reset signal, and a second resistor connected between the first resistor and a ground. A delay time to delay the reset signal is determined by the first and second resistors and a parasitic capacitance related to the second resistor. The reset signal delaying unit further includes a reverse current preventing diode.

In accordance with another aspect of the present invention, a flicker preventing apparatus of a fluorescent lamp includes: a power switch; a power supplying unit to receive an alternating current voltage and to output one or more direct current voltages; a reset signal generator to receive any one of the direct current voltages from the power supplying unit and to generate a reset signal; a reset signal delaying unit to delay the reset signal; a fluorescent lamp to receive another of the direct current voltages from the power supplying unit; a switch to supply the another of the direct current voltages to the fluorescent lamp; and a restrictor to restrict operation of the switch while the reset signal is delayed even when the power switch is turned on and a condition to turn on the switch is satisfied.

The switch comprises a field effect transistor connected between the power supplying unit and the fluorescent lamp. The restrictor includes a first transistor connected to the field effect transistor and a second transistor connected to an emitter of the first transistor. The field effect transistor is turned on when the first and second transistors are both turned on.

The second transistor is turned on when the delayed reset signal is activated, and turned off when the delayed reset signal is inactivated.

According to an aspect of the present invention, an apparatus to supply power to a lamp includes a first switch to selectively supply power to the lamp, a second switch to selectively turn on the first switch, and a third switch to selectively turn on the second switch, wherein the first switch supplies power to the lamp only when the third switch turns on the second switch to avoid supplying power that causes the lamp to flicker.

According to an aspect of the present invention, a method of controlling an apparatus to supply power to a lamp includes selectively turning on a first switch to supply power to the lamp, selectively turning on a second switch to turn on the first switch, and selectively turning on a third switch to turn on the second switch, wherein the first switch supplies power to the lamp only when the third switch turns on the second switch to avoid supplying power that causes the lamp to flicker.

According to an aspect of the present invention, a method of controlling an apparatus to supply power to a lamp wherein switching operation of a switch that supplies a direct current voltage to the lamp is restricted during a transient period to delay a reset signal so that undesired flicker of the lamp is reduce and/or prevented.

According to an aspect of the present invention, an apparatus to supply power to a fluorescent lamp includes a power switch, a power supply to supply one or more DC voltages to the fluorescent lamp, and a controller to activate a fluorescent lamp control signal, wherein even when the fluorescent lamp control signal is improperly and/or unintentionally activated when the power switch is turned on and/or off, one or more of the DC voltages are not supplied to the fluorescent lamp.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which:

FIG. 1C is a graph illustrating a direct current voltage outputted from the power supplying unit when a power switch is turned on;

DETAILED DESCRIPTION OF THE EMBODIMENTS

Figure 1A:
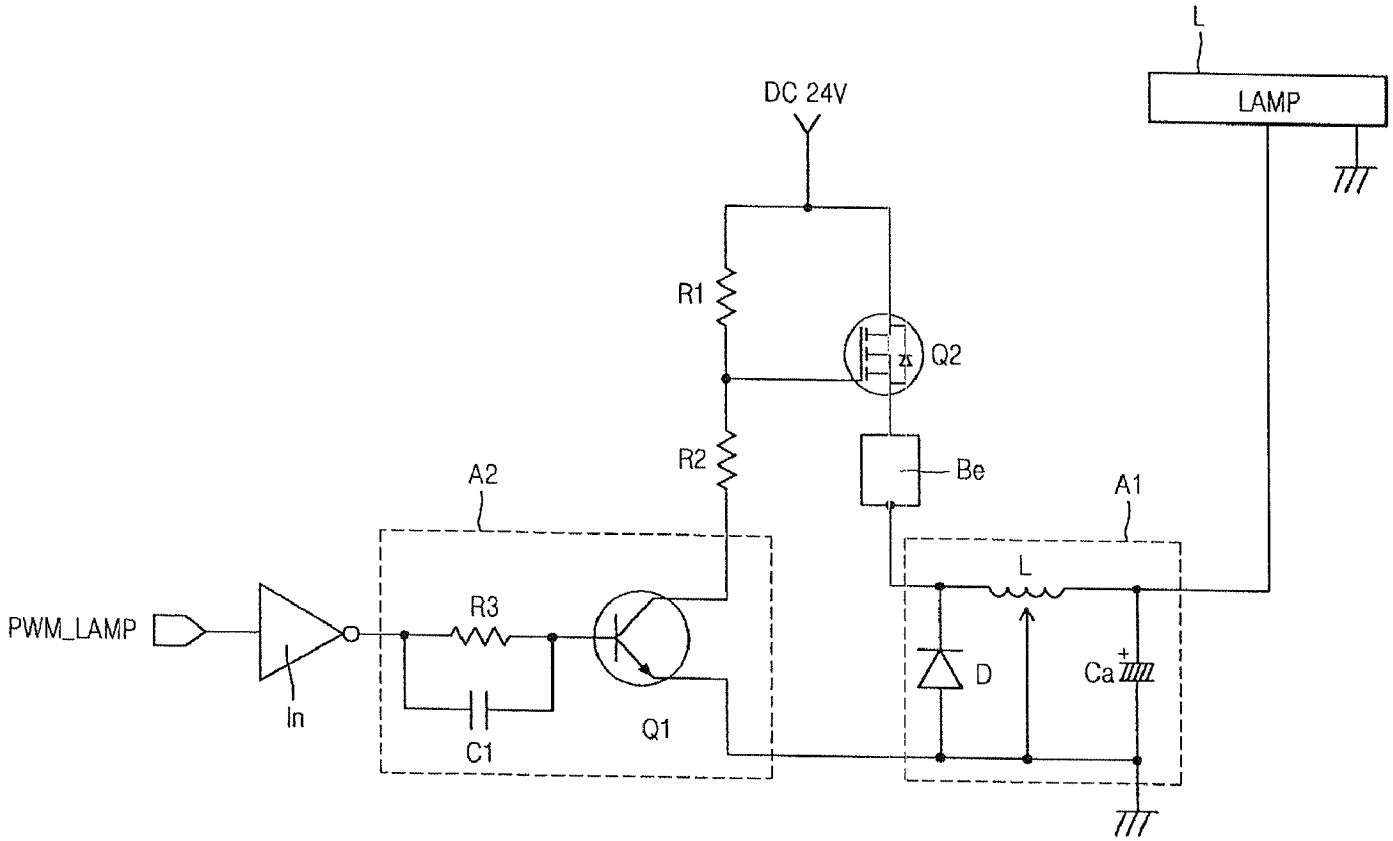
FIG.1A RELATED ART
FIG. 1A is a view illustrating a related art controlling circuit of a fluorescent lamp.

Reference will now be made in detail to aspects of the present invention, examples of which are illustrated in the accompanying drawings, wherein like reference numerals refer to the like elements throughout. The aspects are described below in order to explain the aspects of the present invention by referring to the figures.

Aspects of the present invention include an improved fluorescent lamp driving circuit.

Figure 2A:
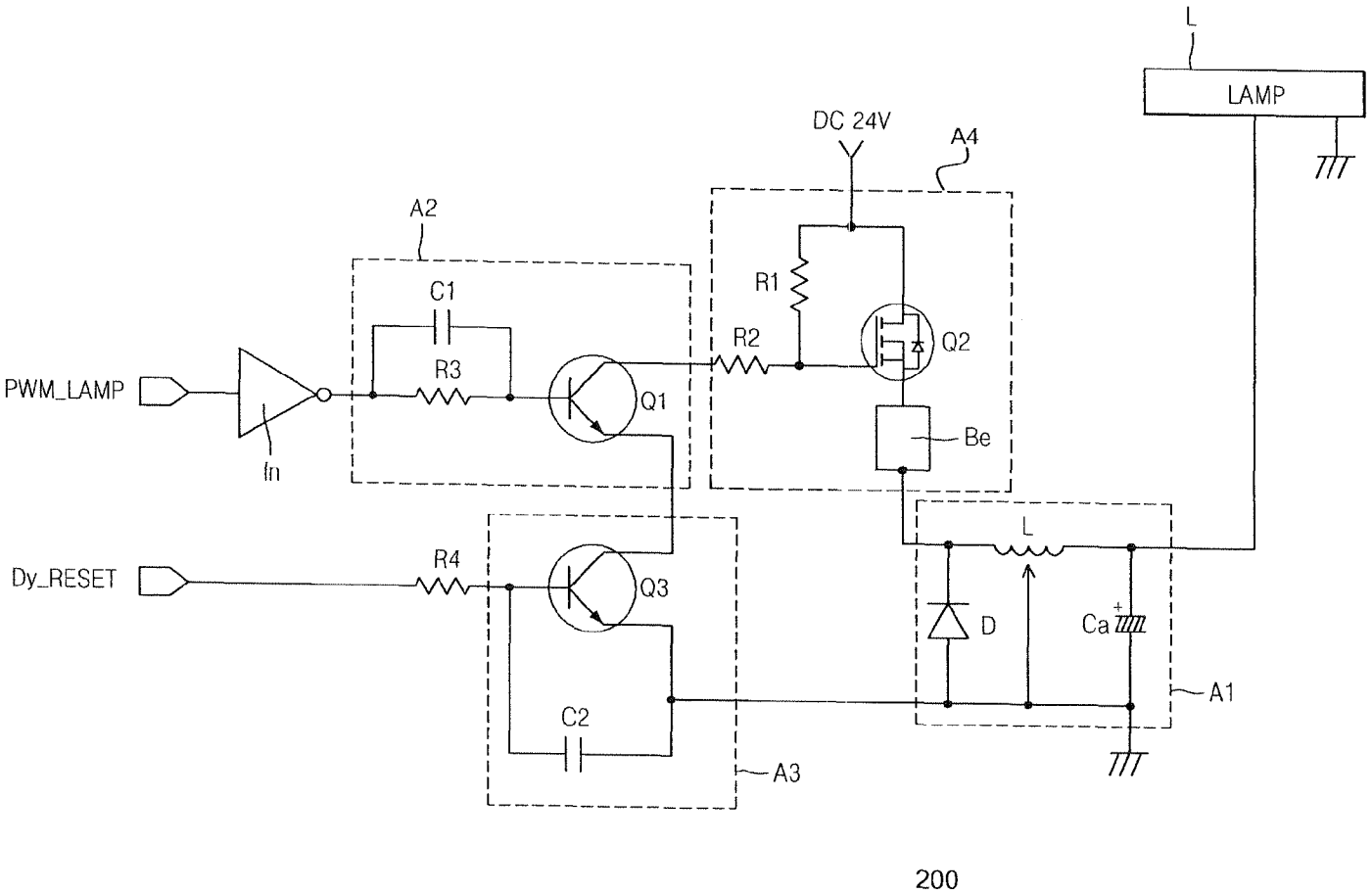
FIG. 2A is a view illustrating a controlling circuit of a fluorescent lamp according to an aspect of the present invention.

FIG. 2A is a view illustrating a controlling circuit 200 of a fluorescent lamp L according to an aspect of the present invention. As shown in FIG. 2A, the controlling circuit 200 includes a smoothing circuit A1, a first switching unit A2, a second switching unit A3, a fluorescent lamp driving circuit A4, and an inverter In.

As shown in FIG. 2A, an activated PWM control signal PWM_LAMP of a "LOW" state is applied to the controlling circuit 200 of a fluorescent lamp L. The PWM control signal PWM_LAMP is applied to a transistor Q1 of a first switching unit A2 via an inverter In to turn on the transistor Q1. Accordingly, a field effect transistor (hereinafter, referred to as an 'FET') Q2 is turned on and a DC voltage (or power) (such as 24 V) is supplied to the fluorescent lamp L. At that time, the PWM control signal PWM_LAMP that corresponds to a magnitude of a voltage supplied to the fluorescent lamp L is output. Accordingly, time when the transistors Q1 and Q2 are turned on is varied and the DC voltage supplied to the fluorescent lamp L via a smoothing unit A1 can be adjusted. As shown in FIG. 2A, reference numerals R1, R2, and R3 indicate resistors, a reference numeral C1 indicates a capacitor to remove noise, and a reference numeral Be indicates a bead inductor to also remove noise.

Figure 1B:
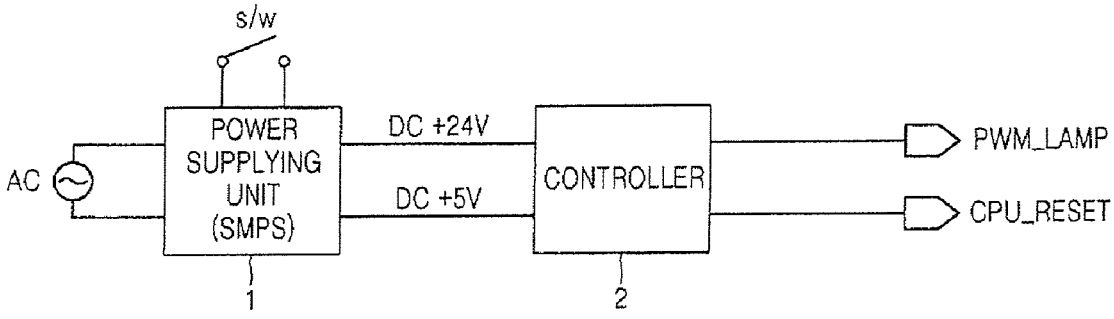
FIG.1B RELATED ART
FIG. 1B is a circuit diagram illustrating a related art power supplying unit and a related art controller to control the fluorescent lamp.

Although not shown, the controlling circuit 200 may be connected to a power supplying unit and a controller that is similar to those shown in FIG. 1B, wherein when the power switch S/W (provided in an image forming apparatus) is turned on, the power supplying unit 1 converts an alternating current (AC) voltage (or power) into one or more direct current (DC) voltages (or powers), such as DC of 24 V, 18V, 12V, and 5 V, and supplies the converted one or more DC voltages to a controller 2. DC of 24 V, 18V, and 12V are supplied to drive the fluorescent lamp L, and the DC of 5 V is supplied to drive the various respective components of the printer. In various aspects of the present invention, other driving voltages, for the fluorescent lamp and/or the various components are within the scope of the invention. In various aspects, smoothly varying driving voltages for the fluorescent lamp L is within the scope of the invention due to the FET and the PWM_LAMP.

Figure 1C:
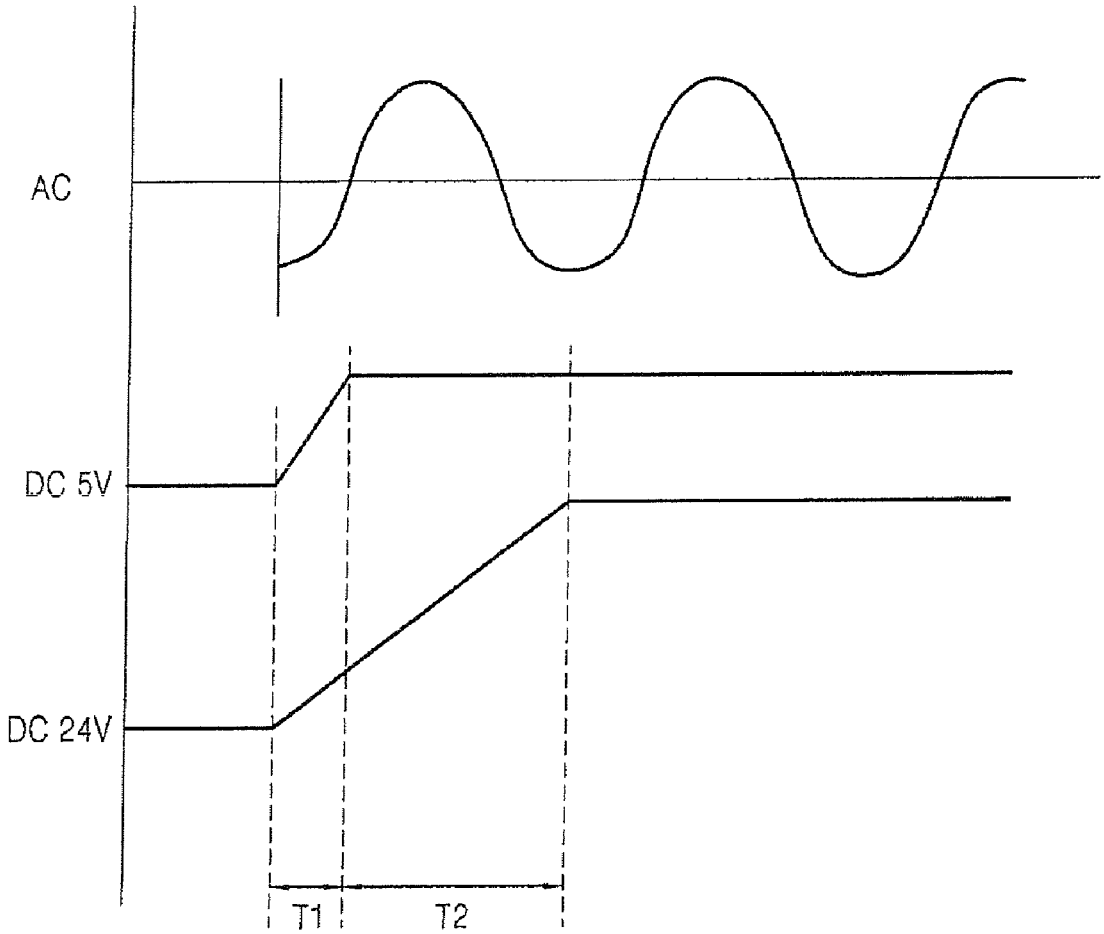
FIG.1C RELATED ART

The controlling circuit 200 may be supplied with any one of DC voltages in a manner similar to those shown in FIG. 1C. For example, the DC of 5 V, that is supplied by the power supplying unit, is stabilized after a transient period T1 elapses, and the other of the DC voltages, such as the DC of 24 V is also stabilized and becomes uniform after another transient period T1+T2 elapses. After the transient period T1+T2, a reset signal that is output from a reset generating circuit (shown below) is stabilized, and the initializing of the various respective components (not shown) is performed by the stabilized reset signal. After the stabilization of the reset signal, the stabilized DC voltage of 24 V is supplied to the fluorescent lamp L to warm up the fluorescent lamp L.

As shown in FIG. 2A, a transistor Q1 of the first switching unit A2 is turned on when an activated pulse width modulation (PWM) control signal PWM_LAMP is applied thereto via the inverter In. Thus, the technique of turning on a fluorescent lamp driving transistor Q2 is similar to that of FIG. 1A.

In greater detail, the fluorescent lamp driving circuit (the controlling circuit 200 of the fluorescent lamp L) according to aspects of the present invention includes the second switching unit A3 that is connected to the first switching unit A2. The second switching unit A3 includes a transistor Q3 and a capacitor C2. The second switching unit A3 restricts the switching operation of the transistor Q1 of the first switching unit A2. A collector of the transistor Q3 is connected to an emitter of the first transistor Q1 of the first switching unit A2, a base of the transistor Q3 is connected to a resistor R4, and an emitter of the transistor Q3 is connected to the smoothing circuit A1. The capacitor C2 has a first end connected to the resistor R4 and a second end connected to the transistor Q3. The capacitor C2 of the second switching unit A3 removes noise. In various aspects, the first switching unit A2 and/or the second switching unit A3 may switch on/off the fluorescent lamp driving circuit A4.

Although the activated PWM control signal PWM_LAMP is applied to the first switching unit A2, the transistor Q1 of the first switching unit A2 is not turned on independently. To turn on the transistor Q1 of the first switching unit A2, the activated PWM control signal PWM_LAMP should be applied at the same time the transistor Q3 of the second switching unit A3 is turned on. The transistor Q3 of the second switching unit A3 can be turned on/off (that is, on and/or off) by a delayed reset signal Dy_RESET transmitted through the resistor R4.

Although the non-limiting aspect of FIG. 2A shows the second switching unit A3 being positioned between the first switching unit A2 and the smoothing circuit A1, various alternate arrangement is also within the scope of the present invention. For example, the second switching unit A3 may be positioned between the fluorescent lamp driving circuit A4 and the first switching circuit, between the fluorescent lamp driving circuit A4 and the smoothing circuit A1, or between the fluorescent lamp L and the smoothing circuit A1.

Figure 2B:
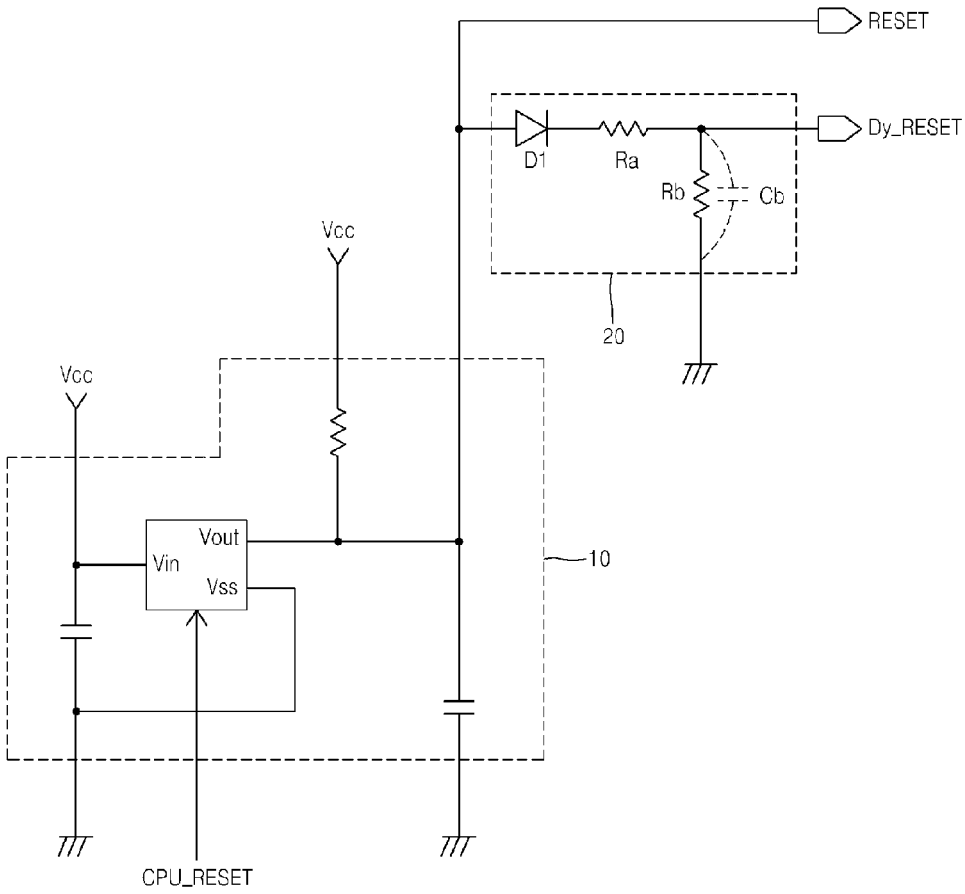
FIG. 2B is a view illustrating a reset signal generator and a reset signal delay according to an aspect of the present invention.

Hereinafter, a reset signal generator 10 and a reset signal delaying unit 20, which respectively generate a reset signal and delays the reset signal will be discussed with reference to FIG. 2B. As shown in FIG. 2B, the reset signal delaying unit 20 is connected to an output end of the reset signal generator 10. The reset signal generator 10 generates a reset signal RESET and outputs the generated reset signal RESET to the RESET input and the reset signal delaying unit 20. The reset signal delaying unit 20 delays the output reset signal RESET for a predetermined time period and provides the delayed reset signal Dy_RESET to the second switching unit A3 (shown in FIG. 2A).

Figure 2C:
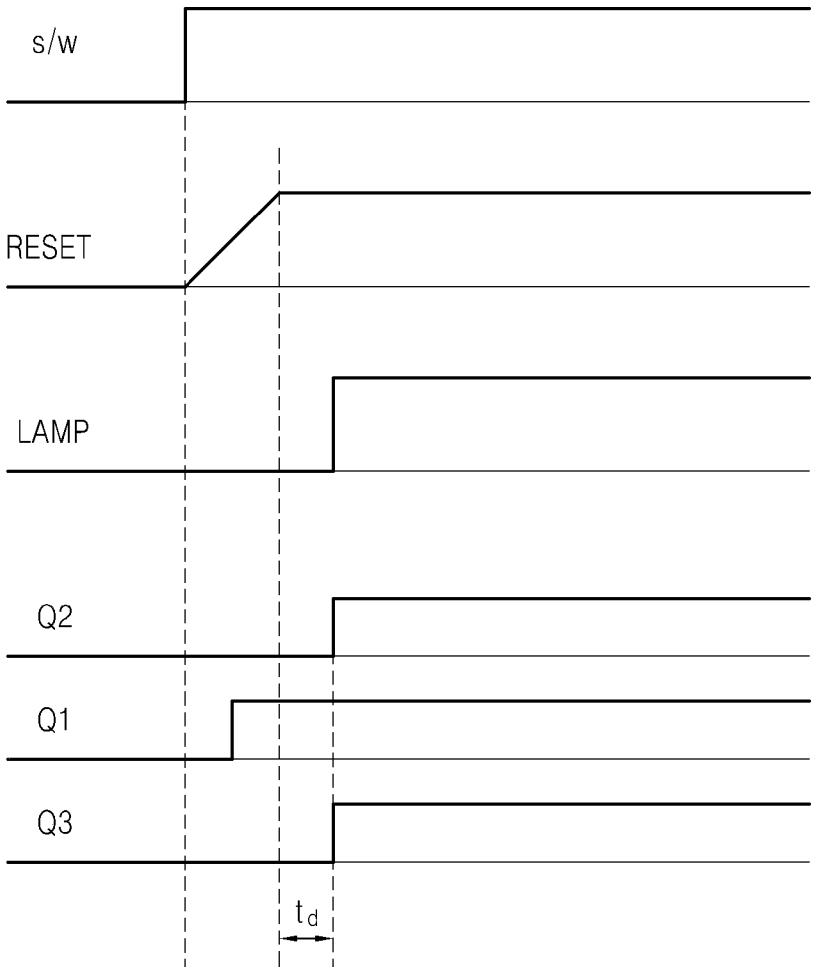
FIG. 2C illustrates a timing graph of when a power switch is turned on and the fluorescent lamp is turned on by a delayed reset signal according to an aspect of the present invention.

As shown in FIG. 2B, the reset signal generator 10 is supplied with at least one driving voltage Vcc (for example, DC 5 V) from the power supplying unit 1 and generates the reset signal RESET. During operation of the reset signal generator 10, voltage of the generated reset signal RESET, as shown in FIG. 2C, increases (or ramps up) after the power switch S/W is turned on and is maintained at a uniform value once a predetermined time elapses. The voltage of the reset signal RESET varies during the predetermined time because of the transient period T1 is taken by the voltage output from the power supplying unit 1 to reach DC 5 V, as described with reference to FIG. 1A.

In order to apply a voltage (or power) to the fluorescent lamp L after the transient period T1, the reset signal delaying unit 20 includes a delay circuit that includes a reverse current preventing diode D1 and resistors Ra and Rb. The resistor Ra is serially connected to the diode D1 and one end of the resistor Rb is connected to the resistor Ra while the other end thereof is grounded. There is a parallel parasitic capacitance of Cb associated with the resistor Rb. A delay time $t_d$ is determined by the resistors Ra, Rb, and the parasitic capacitance Cb, as shown in FIG. 2C. The reset signal delaying unit 20 delays application of the reset signal RESET by a delay time $t_d$ once the reset signal RESET is stabilized.

As shown in FIGS. 2B and 2C, the reset signal RESET is delayed and provided to the second switching unit A3 as a delayed signal Dy_RESET by the reset signal delaying unit 20. Accordingly, although the transistor Q1 of the first switching unit A2 is turned on by receiving the activated PWM control signal PWM_LAMP while the reset signal RESET is being delayed to produce the delayed reset signal Dy_RESET, the transistor Q3 of the second switching unit A3 is still off (or not yet turned on) because of the delayed application of the reset signal in the form of the delayed reset signal Dy_RESET. Accordingly, at least one of the driving voltages is not supplied prematurely and/or unintentionally to the fluorescent lamp L, and the fluorescent lamp does not flicker.

Also, as shown in FIG. 2C, after the delay time $t_d$ elapses, the transistor Q3 of the second switching unit A3 receives the delayed reset signal Dy_RESET and the transistor Q3 is turned on so that the fluorescent lamp driving transistor Q2 is also turned on. Thus, the driving voltage, such as the stabilized DC voltage of 24 V is supplied to the fluorescent lamp L to warm up the fluorescent lamp L.

After the warming-up of the fluorescent lamp L, the reset signal RESET outputted from the reset signal generator 10 is inactivated by being set to "LOW". By doing so, the transistor Q3 of the second switching unit A3 is turned off and the DC voltage is not supplied to the fluorescent lamp L.

Figure 2D:
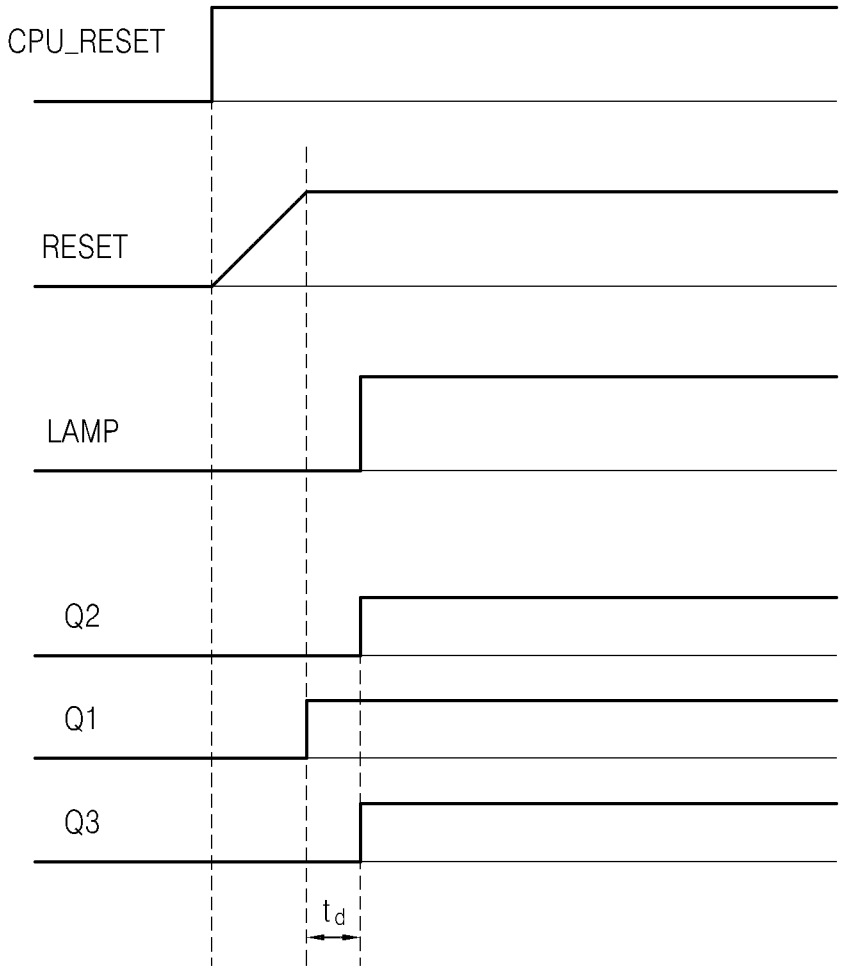
FIG. 2D illustrates a timing graph of when the fluorescent lamp is turned on by the delayed reset signal in response to a reset request command during a standby state according to an aspect of the present invention.

When the DC voltage of 18 V is supplied to the fluorescent lamp L for the scanning or the DC voltage of 12 V is supplied to the fluorescent lamp L for the standby state, the controller 2 outputs a reset requesting command CPU_RESET to the reset signal generator 10 to activate (or generate) the reset signal RESET. The reset signal generator 10 activates the reset signal RESET according to the reset requesting command CPU_RESET. As shown in FIG. 2D, the reset signal delaying unit 20 again delays the activated (or generated) reset signal RESET and outputs the delayed reset signal Dy_RESET to the second switching unit A3 such that the transistor Q3 of the second switching unit A3 is turned on. If the transistor Q1 of the first switching unit A1 is turned on by the activated PWM control signal PMW_LAMP, the controller 2 supplies the relevant DC voltage to the fluorescent lamp L.

Figure 2E:
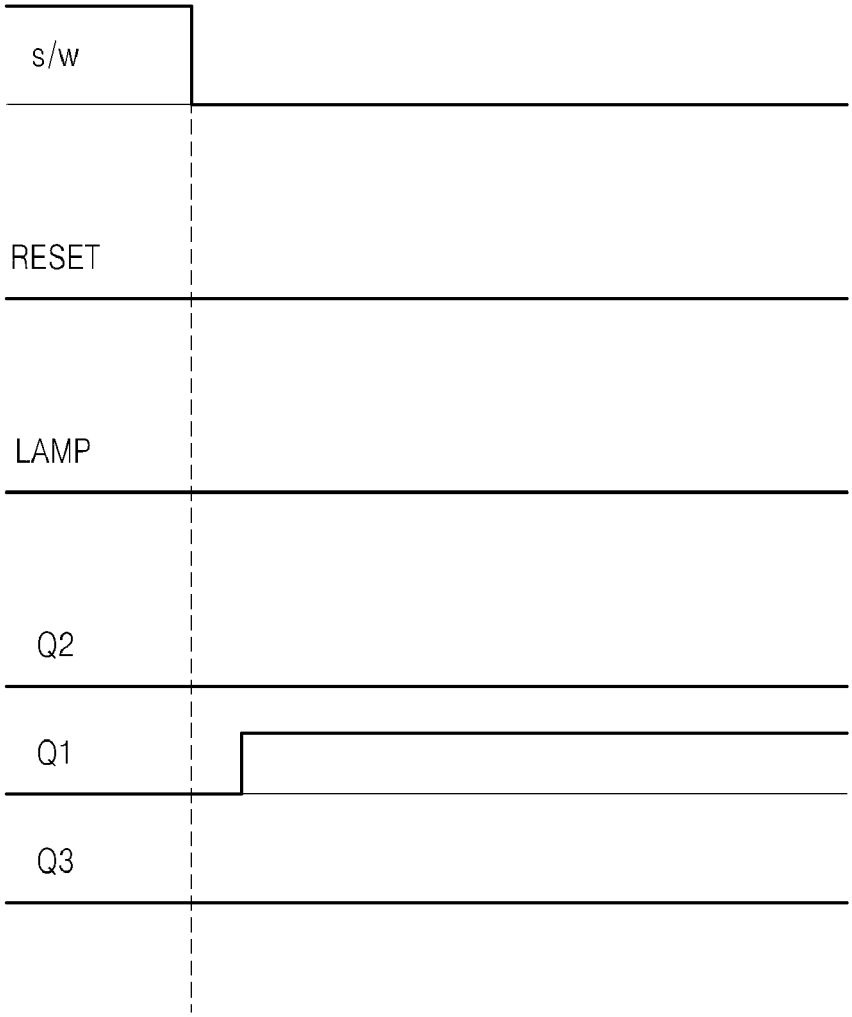
FIG. 2E illustrates a timing graph of when the power switch is turned off and the fluorescent lamp maintains the turn-off state according to an aspect of the present invention.

Once operation of the image forming apparatus is complete and/or when the power switch S/W is turned off at the turning-off of the fluorescent lamp L, as shown in FIG. 2E, the reset signal RESET is inactivated (or ceased to be generated), and even if the controller 2 outputs the activated PWM control signal, the transistor Q3 of the second switching unit A3 is not turned on. Accordingly, the flicker of the fluorescent lamp L is reduced and/or prevented as a result.

As described above, according to aspects of the present invention, although the fluorescent lamp control signal may be improperly or unintentionally activated (or generated) and outputted when the power switch is turned on or off, the DC voltage (or power) is not supplied to the fluorescent lamp and the fluorescent lamp does not flicker (and/or flash). Thus, the user can be reduced and/or prevented from being surprised by a bright light that is instantaneously generated from the fluorescent lamp and a lifespan of the fluorescent lamp is reduced and/or prevented from being shortened.

In various aspects, an image forming apparatus includes a printer, a copier, a scanner, a fax, or any combinations thereof. Also, although shown as being implemented with transistors, such as bipolar junction transistors and field effect transistors, the switches and circuits may be implemented with any switch and/or switching device to turn on/off power, current, and/or voltage or others.

Although a few aspects of the present invention have been shown and described, it would be appreciated by those skilled in the art that changes may be made in this aspect without departing from the principles and spirit of the invention, the scope of which is defined in the claims and their equivalents.

What is claimed is:

1. A flicker preventing apparatus of a fluorescent lamp comprising:

a power switch;

a power supplying unit to supply a direct current voltage by operation of the power switch;

a fluorescent lamp turned on by the direct current voltage from the power supplying unit;

a switch switched to control supply of the direct current voltage to the fluorescent lamp;

a first switching unit to control the switch;

a second switching unit to restrict operation of the switch to prevent the fluorescent lamp from flickering when the power switch is turned one of on and off.

2. The flicker preventing apparatus of a fluorescent lamp according to claim 1, further comprising a reset signal delaying unit to delay an activated reset signal generated in response to the operation of the power switch, wherein the second switching unit turns the switch off while the reset signal delaying unit delays the activated reset signal.

3. The flicker preventing apparatus of a fluorescent lamp according to claim 2, wherein the second switching unit turns the switch off when the reset signal is inactivated.

4. The flicker preventing apparatus of a fluorescent lamp according to claim 2, wherein the reset signal delaying unit comprises:

a first resistor to receive a reset signal; and a second resistor connected between the first resistor and a ground, wherein a delay time to delay the reset signal is determined by the first and second resistors and a parasitic capacitance related to the second resistor.

5. The flicker preventing apparatus of a fluorescent lamp according to claim 4, wherein the reset signal delaying unit further comprises a reverse current preventing diode.

6. The flicker preventing apparatus of a fluorescent lamp according to claim 1, wherein the second switching unit comprises:

a transistor having a collector connected to the first switching unit and an emitter connected to a ground; and a capacitor to remove noise and connected to a base of the transistor and the emitter.

7. The flicker preventing apparatus of a fluorescent lamp according to claim 6, further comprising a controller to output a lamp controlling signal to the first switching unit so as to adjust the direct current voltage supplied to the fluorescent lamp, wherein the first switching unit includes a transistor, and the transistor of the first switching unit is turned on by the lamp controlling signal activated by the controller, the transistor of the second switching unit is turned on by a delayed reset signal, and the switch supplies the direct current voltage to the fluorescent lamp when the transistor of the first switching unit and the transistor of the second switching unit are both turned on.

8. A flicker preventing apparatus of a fluorescent lamp comprising:

a power switch;

a power supplying unit to receive an alternating current voltage and to output one or more direct current voltages;

a reset signal generator to receive any one of the direct current voltages from the power supplying unit and to generate a reset signal;

a reset signal delaying unit to delay the reset signal;

a fluorescent lamp to receive another of the direct current voltages from the power supplying unit;

a switch to supply the another of the direct current voltages to the fluorescent lamp; and a restrictor to restrict operation of the switch while the reset signal is delayed even when the power switch is turned on and a condition to turn on the switch is satisfied.

9. The flicker preventing apparatus of a fluorescent lamp according to claim 8, wherein:

the switch comprises a field effect transistor connected between the power supplying unit and the fluorescent lamp, and the restrictor comprises:

a first transistor connected to the field effect transistor; and a second transistor connected to an emitter of the first transistor, wherein the field effect transistor is turned on when the first and second transistors are both turned on.

10. The flicker preventing apparatus of a fluorescent lamp according to claim 9, wherein the second transistor is turned on when the delayed reset signal is activated, and turned off when the delayed reset signal is inactivated.

* * * * *